US012546318B2

(12) United States Patent
Busch et al.

(10) Patent No.: US 12,546,318 B2
(45) Date of Patent: Feb. 10, 2026

(54) POSITIVE DISPLACEMENT MACHINE BASED ON THE SPIRAL PRINCIPLE

(71) Applicant: OET GMBH, Lustenau (AT)

(72) Inventors: Christian Busch, Feldkirch (AT); Roman Lässer, Wolfurt (AT); Dominik Brosi, Dornbirn (AT)

(73) Assignee: OET GMBH, Lustenau (AT)

( * ) Notice: Subject to any disclaimer, the term of this patent is extended or adjusted under 35 U.S.C. 154(b) by 0 days.

(21) Appl. No.: 18/722,489

(22) PCT Filed: Nov. 11, 2022

(86) PCT No.: PCT/EP2022/081661
§ 371 (c)(1),
(2) Date: Jun. 20, 2024

(87) PCT Pub. No.: WO2023/117209
PCT Pub. Date: Jun. 29, 2023

(65) Prior Publication Data

US 2025/0059976 A1 Feb. 20, 2025

(30) Foreign Application Priority Data

Dec. 22, 2021 (DE) ..... 102021134255.4

(51) Int. Cl.
*F04C 29/04* (2006.01)
*F04C 18/02* (2006.01)

(52) U.S. Cl.
CPC ..... *F04C 29/04* (2013.01); *F04C 18/0215* (2013.01)

(58) Field of Classification Search
CPC ..... F04C 29/04; F04C 29/047; F04C 29/045; F04C 18/0215; F04C 18/0207;
(Continued)

(56) References Cited

U.S. PATENT DOCUMENTS 10,801,496 B2 * 10/2020 Obrist ..... F04C 18/0215
2002/0025268 A1 2/2002 Moroi et al.
(Continued)

FOREIGN PATENT DOCUMENTS

DE 10232648 A1 2/2003
DE 102015220131 A1 4/2017
(Continued)

OTHER PUBLICATIONS

International Search Report issued in PCT/EP2022/081661 (Feb. 8, 2023).

*Primary Examiner* — Dapinder Singh
(74) *Attorney, Agent, or Firm* — Merchant & Gould P.C.

(57) ABSTRACT

The invention relates to a positive displacement machine working according to the spiral principle, in particular a scroll compressor, comprising a compressor section and a motor section, wherein an orbiting displacement spiral and a counter spiral are arranged in the compressor section, which engage into one another in such a way that variable compression chambers are formed between the displacement spiral and the counter spiral in order to receive and compress a working medium flowing through a working medium circuit, wherein an electric motor is arranged in the motor section, which is drive-connected to the displacement spiral, and wherein a cooling device is provided for cooling the electric motor. The invention is characterized in that the cooling device is independent of the working medium circuit.

12 Claims, 3 Drawing Sheets

Figure 1:
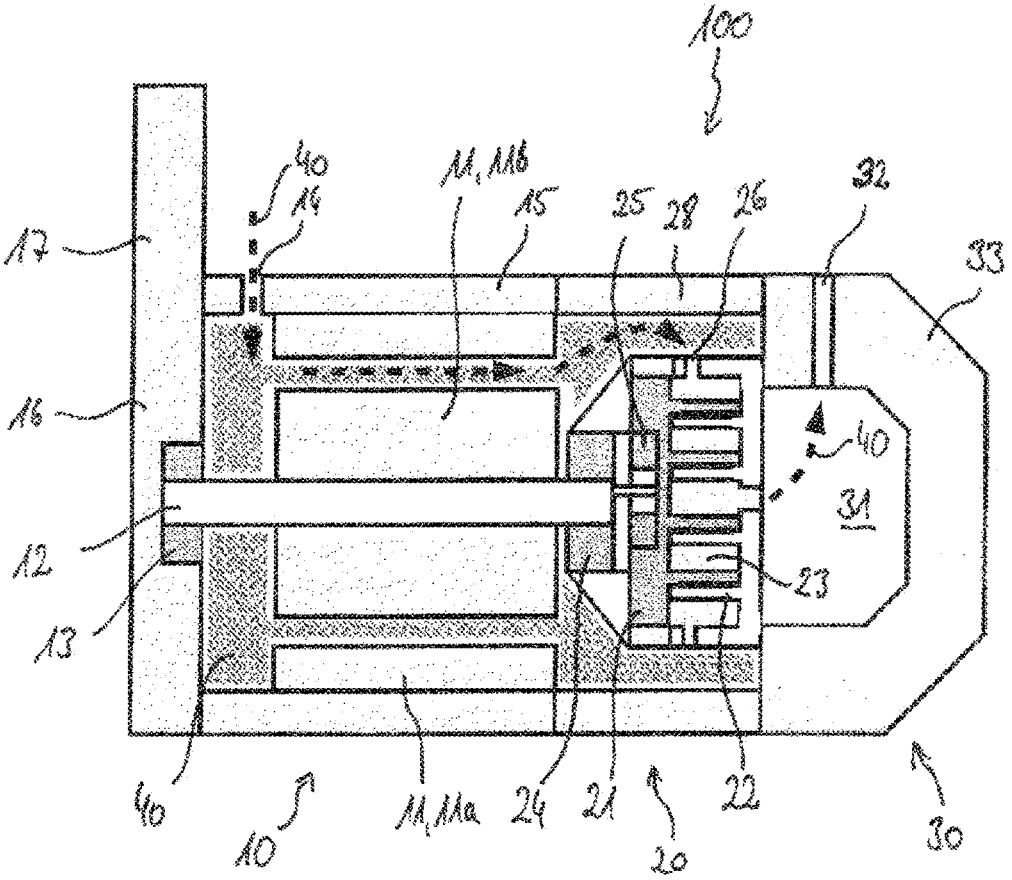
Fig. 1 (Prior Art)

(58) Field of Classification Search
CPC .. F04C 23/008; F04C 23/02; F04C 2240/808; F04C 2240/30; F04C 2240/403; B60H 1/3226; H02K 9/225; H02K 9/08; H02K 11/33
See application file for complete search history.

(56) References Cited

U.S. PATENT DOCUMENTS

| | | | | |
|---|---|---|---|---|
| 2003/0017070 | A1* | 1/2003 | Moroi | F04C 29/045 418/101 |
| 2009/0068035 | A1* | 3/2009 | Valbjoern | F04B 39/12 417/410.1 |
| 2015/0044075 | A1* | 2/2015 | Abe | F04B 39/12 417/349 |
| 2018/0335032 | A1* | 11/2018 | Obrist | F04C 18/0215 |

FOREIGN PATENT DOCUMENTS

| | | | |
|---|---|---|---|
| DE | 112018005240 | T5 | 7/2020 |
| JP | S61-200391 | A | 9/1986 |
| JP | H03-57895 | A | 3/1991 |
| JP | 2008121930 | A | 5/2008 |
| WO | 2017/108572 | A1 | 6/2017 |
| WO | 2019087868 | A1 | 5/2019 |

* cited by examiner

POSITIVE DISPLACEMENT MACHINE BASED ON THE SPIRAL PRINCIPLE

This application is a National Stage Application of International Patent Application No. PCT/EP2022/081661, filed Nov. 11, 2022, which claims benefit of priority to German Patent Application No. 102021134255.4, filed on Dec. 22, 2021, which applications are incorporated herein by reference in their entirety. To the extent appropriate, a claim of priority is made to each of the above disclosed applications.

The invention relates to a positive displacement machine. Furthermore, the invention relates to a vehicle, in particular, a battery powered electric vehicle or fuel cell vehicle, comprising such a positive displacement machine and the use of such a positive displacement machine.

A positive displacement machine of the type mentioned at the outset is known, for example, from WO 2017/108572 A1. In case of the well-known positive displacement machine, the working medium, also known as a refrigerant, is fed into the compressor section via a motor section of the positive displacement machine. The motor section, which comprises an electric motor that drives the compressor in the compressor section, is thereby cooled by the working medium.

Up to now, it has been common practice in prior art for positive displacement machines based on the spiral principle, so-called scroll compressors, to guide the working medium that is to be compressed in the scroll compressor through the motor section in order to cool the electric motor. In most cases, the working medium is also guided via an inverter of the electric motor in order to absorb its heat losses as well. In this way, while the inverter and the electric motor are cooled down by the working medium, the working medium absorbs heat energy and thereby, it is preheated before entering the compressor section. The higher temperature of the working medium reduces its density level so that the mass flow of working medium conveyed by the compressor section is reduced. In addition, there are pressure losses that occur when flowing through the motor section, wherein these pressure losses also reduce the density level of the working medium when flowing into the compressor section.

With this type of cooling device for the electric motor, it is therefore accepted that the working medium enters the compressor section at a reduced density level, which reduces the cooling capacity of the overall system.

Simultaneously, the increase in temperature of the working medium before entering the compressor section and the pressure losses in the motor section cause the outlet temperature of the working medium of the positive displacement machine to be increased. The pressure losses occurring in the motor section also have the effect that the pressure ratio in the working medium circuit increases, thereby requiring an increased drive power of the positive displacement machine.

The object of the invention is to improve the thermal efficiency of a positive displacement machine according to the spiral principle with relation to prior art. Furthermore, it is the object of the invention to specify a vehicle with such a positive displacement machine and the use of such a positive displacement machine.

According to the invention, this task is solved by means of the positive displacement machine herein, by means of the Vehicle herein, and by means of the use herein.

In this way, the invention is based on the idea of specifying a positive displacement machine based on the spiral principle, in particular, a scroll compressor, wherein the positive displacement machine comprises a compressor section and a motor section. An orbiting displacement spiral and a counter spiral are arranged in the compressor section that engage into one another in such a way that variable compression chambers are formed between the displacement spiral and the counter spiral in order to receive and compress a working medium flowing through a working medium circuit. An electric motor is arranged in the motor section, which is drive-connected to the displacement spiral by the drive, wherein a cooling device is provided for cooling the electric motor. According to the invention, the cooling device is independent of the working medium circuit.

In other words, in contrast to prior art, the invention provides for the cooling of the electric motor or the motor section to be independent of the working medium circuit. In this respect, a separation of functions is therefore intended, in which the function of cooling the electric motor is at least partially separated from the function of the working medium. This does not exclude the possibility that there are embodiments of the invention in which working medium continues to flow through the motor section. However, the motor section, in particular, the electric motor, is at least additionally cooled by a separate cooling device so that the working medium does not necessarily absorb the waste heat from the electric motor completely. Rather, the working medium remains at a relatively low temperature level so that the working medium enters the compressor section at a higher density level with relation to prior art. This efficiently increases the cooling capacity of the overall system.

In a preferred embodiment of the invention, the working medium circuit comprises a compressor feed which flows directly into the compressor section, in particular, directly from outside the positive displacement machine. The working medium circuit can be designed completely independently of the motor section of the positive displacement machine so that no working medium flows through the motor section. As a result, the working medium flows directly into the compressor section without first absorbing thermal energy from the motor section. Alternatively, it can be provided that the working medium circuit is divided so that a first part of the working medium flows through the motor section and contributes to the cooling of the electric motor, and a second part enters the compressor section directly via the compressor feed, thereby not being used to cool the electric motor. Both of the aforementioned alternatives further increase the cooling capacity of the overall system.

In a particularly preferred embodiment of the invention, the cooling device comprises a cooling medium circuit. The cooling of the electric motor, in particular, the motor section, can therefore be carried out via a separate cooling medium circuit, wherein the cooling medium circuit is preferably completely fluid-independent of the working medium circuit. In particular, there is no fluid exchange between the working medium circuit and the cooling medium circuit.

The cooling device, in particular, the cooling circuit, can be thermally coupled with the working medium circuit or a bypass of the working medium circuit. In particular, thermal coupling can be carried out by means of a heat exchanger. In general, it is therefore possible that there is a thermal coupling between the working medium circuit and the cooling device so that the working medium is also cooled by the cooling device. The cooling of the working medium or part of the working medium is particularly useful if the working medium or part of it is passed through the motor section. If the working medium circuit or a bypass of the working medium circuit comprises the motor section, thermal coupling between the working medium circuit and the cooling device can be provided, in particular, upstream to or downstream from the motor section.

For example, before the working medium enters the motor section, i.e., before an motor feed, a heat exchanger can be provided which couples the working medium circuit or the bypass of the working medium circuit with a cooling medium circuit. As a result, the working medium is pre-cooled and heated to a lower temperature level than without pre-cooling by absorbing thermal energy as it flows through the motor section. However, it is particularly preferable if the heat exchanger, which thermally couples the working medium circuit or its bypass with the cooling medium circuit, is provided between the motor section and the compressor section, in particular a chamber feed of the compressor section. In particular, the heat exchanger can be provided between the motor section and a chamber feed of the compressor section. The working medium, which is preheated by absorbing heat energy in the motor section, is thus cooled down again before it is fed into the compressor section or its chamber feed and can thus absorb a higher level of compression energy.

In another preferred embodiment of the invention, it is provided that the cooling medium circuit is arranged completely outside the electric motor. For example, the cooling medium circuit can comprise channels within a housing of the motor section. The cooling medium flows through these channels and absorbs the heat from the electric motor located in the motor section. Alternatively, it is possible for the cooling medium circuit to extend through the electric motor, at least in sections. In contrast to prior art, in which working medium flows through the electric motor, this embodiment provides that a refrigerant separate from the working medium flows through the electric motor. If the cooling medium circuit runs through the electric motor, at least in sections, the cooling function for the electric motor is completely independent of the working medium circuit.

In such a variant, it is advisable if at least the stator is fluid-tight and separated from the areas of the positive displacement machine conveying working medium. This can be achieved, for example, by a separating can that hermetically separates the stator from the rotor of the electric motor.

In this regard, reference is made to the German patent application filed on the same day entitled "Kaltemittelverdichter" (Refrigerant compressor), which can be traced back to the same applicant.

In the case of the positive displacement machine according to the invention, an inverter may also be provided for the electrical control of the electric motor. Preferably, the cooling device, particularly the cooling medium circuit, is thermally coupled to the inverter. Heat losses occur in the inverter, i.e., heat energy that must be dissipated to prevent the inverter from overheating. This can be done efficiently by the cooling device, which is independent of the working medium circuit. This also avoids the problem known from prior art that the working medium heats up during the heat dissipation of the heat loss of the inverter and loses density even before it enters the compressor section.

The cooling of the inverter via the cooling device, which is independent of the working medium circuit, therefore continues to serve to increase the cooling capacity of the overall system.

In a preferred embodiment of the invention, the inverter is attached to the housing of the motor section or integrated into the housing of the motor section. The cooling device can thus also be integrated into the motor section, providing a particularly compact yet powerful positive displacement machine.

Alternatively, the inverter can also be designed independently of the motor section and compressor section. Such a design has advantages if, due to installation space requirements, for example in a vehicle, direct coupling of the inverter to the motor section is not expedient. The inverter can still be thermally coupled to the cooling device, wherein in such cases a cooling device that comprises a cooling medium circuit is preferred. For example, a uniform liquid cooling device can be used to cool both the inverter as well as the motor section installed independently of the inverter.

It is also possible that the cooling device comprises heat pipes. The cooling of the electric motor and, where applicable, also of the inverter can therefore be carried out via a cooling device that comprises heat pipes. Such a cooling device can also have a cooling medium circuit. In this context, it is also possible that if the inverter and motor section are arranged separately, separate heat pipes are provided for the inverter and the motor section. In general, it can be provided that separate cooling devices are used for cooling the electric motor and cooling the inverter.

A secondary aspect of the invention relates to a vehicle, in particular, a multi-track motor vehicle with a positive displacement machine described above. The vehicle or multi-track motor vehicle is preferably a battery-powered electric vehicle or a fuel cell vehicle. The aforementioned vehicle types usually have a relatively large storage capacity for electrical energy so that these vehicle types are particularly suitable for the separate cooling of the motor section or electric motor of the positive displacement machine. Provisions for this are already in place in the vehicle so that the positive displacement machine can be integrated particularly easily into such vehicles. Particularly in these vehicles, high efficiency, which is achieved with the positive displacement machine described above, is favourable, as the cooling capacity of the overall system is improved.

In a preferred variant of the vehicle according to the invention, it is provided that the inverter is structurally arranged independently of the motor section and/or the compressor section in the vehicle. Such a design is favourable, for example, to make optimal use of the installation space in such vehicles. The independent arrangement of the inverter can also be provided to place the inverter in a place that is easy to maintain or to combine it with other electronic components of the battery-powered electric vehicle or fuel cell vehicle.

The positive displacement machine described here has the advantage that it can be used for cooling on the one hand, wherein the positive displacement machine is used as a refrigerant compressor. However, the same positive displacement machine can also be used for heating, wherein the positive displacement machine then acts as a heat pump.

This can be done simply by reversing the flow of working medium, i.e., by not compressing the working medium in the compressor section, but rather by expanding it. In this respect, a separate aspect of the invention is directed to indicate the use of the previously described positive displacement machine as a refrigerant compressor for cooling and/or as a heat pump for heating.

Figure 2:
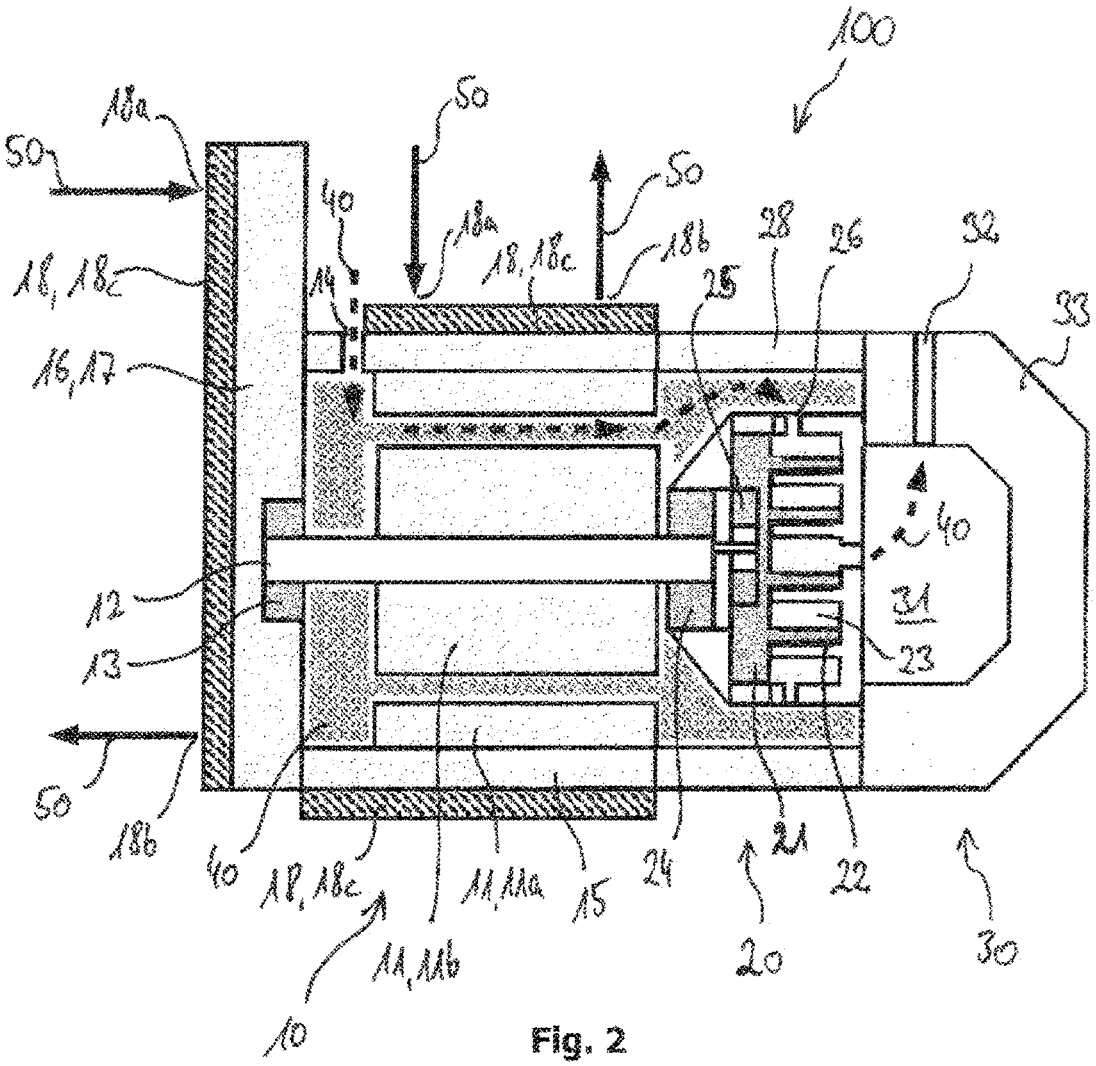
Figure 3:
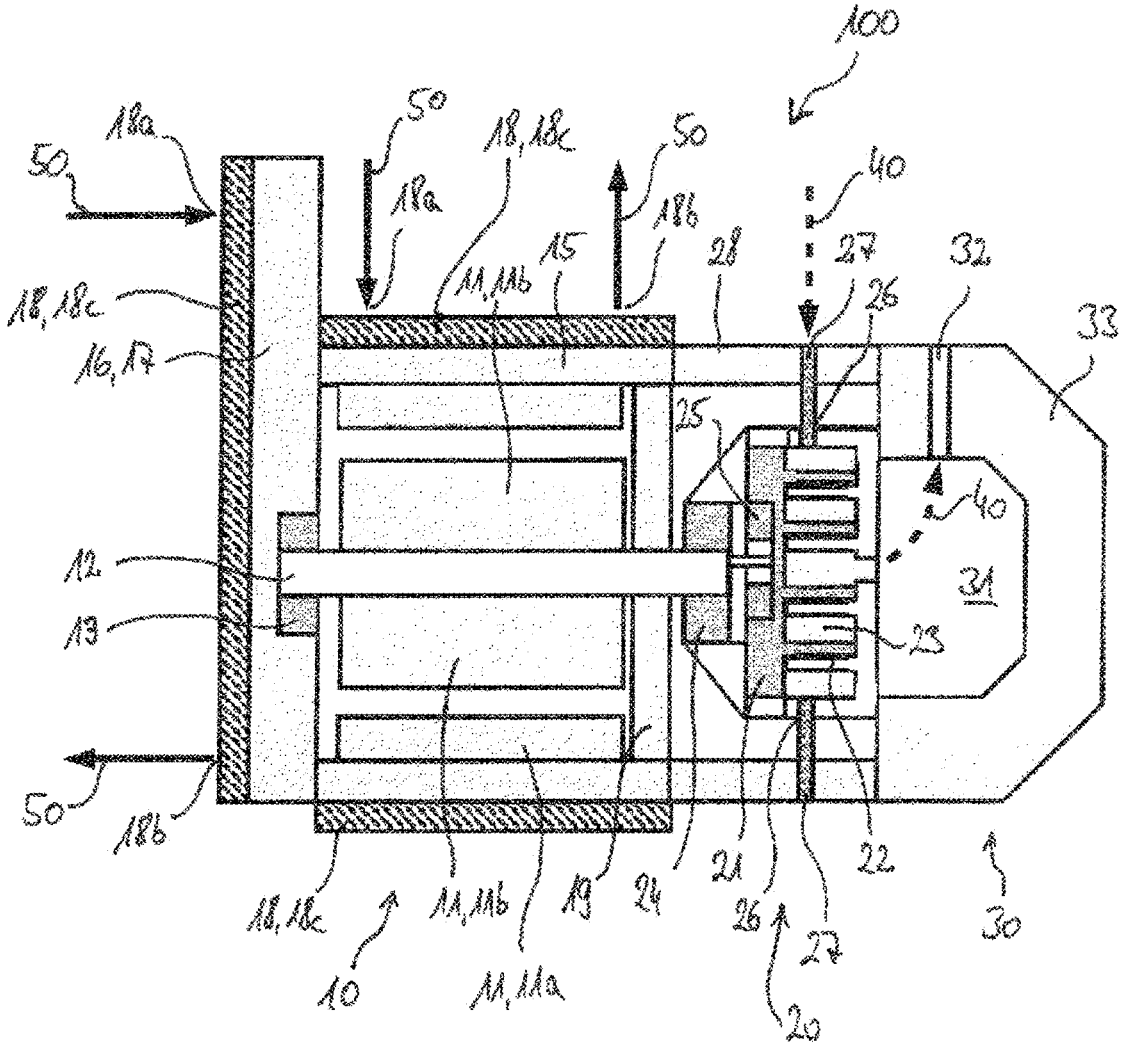

The invention is explained in more detail below by means of exemplary embodiments with reference to the following schematic drawings. The figures show:

FIG. 1 a cross-sectional view of a positive displacement machine from prior art;

FIG. 2 a cross-sectional view of a positive displacement machine according to the invention in accordance with a preferred exemplary embodiment; and FIG. 3 a cross-sectional view of a positive displacement machine according to the invention in accordance with another preferred exemplary embodiment.

FIG. 1 shows a positive displacement machine 100 according to the conventional design. The positive displacement machine 100 comprises a motor section 10, a compressor section 20 and a high-pressure section 30. In the motor section 10, an electric motor 11 is arranged, which drives a drive shaft 12. The drive shaft 12 is mounted in a motor-side bearing 13 and a compressor-side bearing 24.

The motor-side bearing 13 is arranged in a housing floor 16 of an motor housing 15. The motor housing 15 accommodates the electric motor 11. An inverter 17 is integrated into the housing floor 16 or arranged on the housing floor 16.

The compressor-side bearing 24 is arranged in the compressor section 20. The drive shaft 12 is connected to a displacement spiral 21 in the compressor section 20 via an eccentric bearing 25. The eccentric bearing 25 is used to set the displacement spiral 21 in orbital motion.

The displacement spiral 21 engages in a counter spiral 22 so that a compression chamber 23 is formed or a plurality of compression chambers 23 are formed between the displacement spiral 21 and the counter spiral 22. The, or each compression chamber 23 is variable, wherein the variability refers to the volume of the compression chamber 23 depending on the position of the displacement spiral 21.

The compressor section 20 comprises a compressor housing 28 that surrounds the displacement spiral 21, the counter spiral 22 and the compression chamber 23. The compressor housing 28 is connected to the motor housing 15.

The high-pressure section 30 connects to the compressor section 20 and comprises a high-pressure housing 33 that encloses a high-pressure chamber 31. The high-pressure housing 33 is firmly connected to the compressor housing 28. It is also possible that the compressor housing 28 and the high-pressure housing 33 are single-piece. The high-pressure section 30 comprises a working medium outlet 32, which extends as a channel through the high-pressure housing 33 and connects the high-pressure chamber 31 with the surrounding area.

In the case of the positive displacement machine 100 from prior art, a working medium 40, which is preferably designed as a refrigerant, flows into motor section 10 via an motor feed 14. The working medium 40 then flows through the electric motor 11, wherein it preferably passes through channels in the stator 11*a* or through an air gap between the stator 11*a* and a rotor 11*b*. A separating can may also extend through the air gap, separating the rotor 11*b* from the stator 11*a* in a fluid-tight manner. A compressor equipped with such a separating can is described in the applicant's German patent application, filed on the same date and entitled "Kaltemtttelverdlchter" (Refrigerant compressor).

The working medium 40 enters the compressor section 20 and is fed into the variable compression chamber 23 in the compressor section 20 via a chamber feed 26. Via the movement of the displacement spiral 21 with relation to the counter spiral 22 and the resulting change in volume of the compression chamber 23, the working medium 40 is compressed and enters the high-pressure chamber 31 under a high level of pressure. The working medium 40 then leaves the positive displacement machine 100 via the working medium outlet 32. The course of working medium 40 is shown in the attached figures by dashed arrows.

In the case of the positive displacement machine 100 from prior art in accordance with FIG. 1, the working medium 40 is therefore not only used to be compressed in the compressor section 20 but is also used to cool the electric motor 11 in the motor section 10 simultaneously. The cooling of the electric motor 11 is carried out in that the working medium 40 absorbs heat energy from the electric motor 11 and heats up in the process. The temperature of the working medium 40 thus rises in the motor section 10, wherein the density level of the working medium 40 decreases. The working medium 40 has a lower density level when entering compressor section 20 than when entering motor section 10. As a result, the working medium 40 can absorb a lower compression energy in the compressor section than would be possible if the working medium 40 did not experience an increase in temperature in the motor section 10. The pressure losses for the working medium 40 occurring during the flow through the motor section 10 also contribute to this effect.

FIG. 2 shows an option according to the invention to avoid these negative effects. Specifically, the positive displacement machine 100 in accordance with FIG. 2 is essentially identical to the positive displacement machine 100 in accordance with FIG. 1. In addition, it is only provided that motor section 10, in particular electric motor 11, is cooled by a cooling device 18 that is independent of the working medium circuit of working medium 40. In the example schematically shown in FIG. 2, the cooling of motor section 10 is carried out via a shell cooling system of motor housing 15. This shell cooling system can generally be solved by means of different cooling elements, for example, via heat pipes or other cooling components.

It is particularly preferable to set up a cooling medium circuit that comprises a cooling medium 50 that circulates in a cooling medium circuit independent of the working medium circuit. The cooling medium 50 can be water, for example.

In this respect, it can therefore be provided that motor section 10 comprises an external water-cooling system.

The shell cooling system or cooling device 18 preferably extends over the entire circumference of motor section 10.

In addition, it can be provided that the cooling device 18 is thermally coupled to the housing floor 16 and/or the inverter 17. In particular, a single cooling medium circuit, such as a water-cooling circuit for example, can be provided, which is thermally coupled to the inverter 17 and the motor housing 15. The cooling medium circuit dissipates heat from the inverter 17 and/or the motor housing 15 and thus also from the electric motor 11. Specifically, a cooling element 18*c* can be arranged on the outside of the motor housing 15 and/or on the outside of the inverter 17, wherein cooling medium inlet 18*a* and a cooling medium outlet 18*b* are assigned to each cooling element 18*c*. The 18*c* cooling elements can be connected in series or in parallel with regard to the cooling medium flow. It is also possible for each cooling element 18*c* to be assigned to a separate cooling device.

As can be seen in FIG. 2, the cooling of the motor section or electric motor is carried out by the cooling medium 50 so that the working medium 40, which flows through the electric motor 11, hardly has to contribute to the temperature of the electric motor 11. As a result, working medium 40 enters compressor section 20 at a lower temperature than is the case in prior art. As a result, the working medium 40 has a lower density level when it enters the chamber feed 26 and can therefore absorb a higher level of compression energy. Overall, this increases the cooling capacity of the entire positive displacement machine.

The exemplary embodiment in accordance with FIG. 3 offers an even further increase in the efficiency of the overall system. This is achieved in that, in contrast to the exemplary embodiment in accordance with FIG. 2, working medium 40 is no longer guided through motor section 10. Rather, the compressor section 20 comprises a separate compressor feed 27, via which the working medium 40 enters directly into the chamber feed 26. In this configuration, the working medium 40 circulates in a working medium circuit that is completely independent of motor section 10. This means that the working medium 40 no longer contributes to the heat dissipation from the motor section 10, i.e., it enters compressor section 20 with unchanged temperature and density.

The cooling of the motor section 10 or the electric motor 11 is carried out in the exemplary embodiment in accordance with FIG. 3 in the same way as the exemplary embodiment in accordance with FIG. 2. Essentially, a cooling element 18*c* is provided, preferably completely encompassing the motor housing 15, which comprises a cooling medium inlet 18*a* and a cooling medium outlet 18*b*. A further cooling element 18*c* can be provided on the inverter 17 and can also comprise a cooling medium inlet 18*a* and a cooling medium outlet 18*b*. The 18*c* cooling elements can be connected in series or in parallel. In any case, it is provided that the cooling medium 50 will flow through the cooling elements 18 and dissipate thermal energy generated during the operation of the electric motor 11 and/or the inverter 17.

In FIG. 3, it can also be recognized that motor section 10 and compressor section 20 are hermetically separated. In particular, a motor partition 19 is provided for this purpose, which completely encapsulates the electric motor 11 from the compressor section 20. It is also possible that the electric motor 11 is equipped with a separating can, which forms a further separation between the electric motor and fluid-carrying sections of the positive displacement machine 20.

In addition to the exemplary embodiments presented here, it is also conceivable that a positive displacement machine 100 comprises a motor section 10, through which a part of the working medium 40 is flowed, wherein another part of the working medium 40 flows directly into the chamber feed 26 via the compressor feed 27. In any case, it is provided that a cooling device 18 independent of the working medium circuit is provided to cool the motor section 10 and/or the inverter 17.

REFERENCE LIST

100 positive displacement machine
10 motor section
11 electric motor
11*a* stator
11*b* rotor
12 drive shaft
13 motor-side bearing
14 motor feed
15 motor housing
16 housing floor
17 inverter
18 cooling device
18*a* cooling medium inlet
18*b* cooling medium outlet
18*c* cooling element
19 motor partition
20 compressor section
21 displacement spiral
22 counter spiral
23 compression chamber
24 compressor-side bearing
25 eccentric bearing
26 chamber feed
27 compressor feed
28 compressor housing
30 high-pressure section
31 high-pressure chamber
32 working medium outlet
33 high-pressure housing
40 working medium
50 cooling medium

The invention claimed is:

1. A positive displacement machine according to the spiral principle, comprising a compressor section and a motor section, wherein, in the compressor section, an orbiting displacement spiral and a counter spiral are arranged that engage into one another in such a way that variable compression chambers are formed between the displacement spiral and the counter spiral in order to receive and compress a working medium flowing through a working medium circuit, wherein an electric motor is arranged in the motor section which is drive-connected to the displacement spiral and wherein a cooling device is provided for cooling the electric motor, wherein the cooling device is independent of the working medium circuit, wherein the cooling device comprises a cooling medium circuit, wherein an inverter is provided for electrical control of the electric motor, and wherein the cooling medium circuit is thermally coupled to the inverter.

2. The positive displacement machine according to claim 1, wherein the working medium circuit comprises a compressor feed which flows directly into the compressor section from outside the positive displacement machine.

3. The positive displacement machine according to claim 1, wherein the cooling device is thermally coupled with the working medium circuit or a bypass of the working medium circuit, in particular, by means of a heat exchanger.

4. The positive displacement machine according to claim 1, wherein the cooling medium circuit is arranged entirely outside the electric motor or extends in sections through the electric motor.

5. The positive displacement machine according to claim 1, wherein the inverter is attached to a motor housing of the motor section or integrated into the motor housing of the motor section.

6. The positive displacement machine according to claim 1, wherein the inverter is designed independently of the motor section and the compressor section.

7. The positive displacement machine according to claim 1, wherein the cooling device comprises heat pipes.

8. A vehicle comprising a positive displacement machine according to claim 1.

9. The vehicle according to claim 8, wherein the inverter is arranged in the vehicle independently of the motor section and/or the compressor section.

10. A heating or cooling method, comprising using the positive displacement machine according to claim 1 as a refrigerant compressor for cooling and/or as a heat pump for heating.

11. The vehicle according to claim 8, wherein the vehicle is a battery powered vehicle.

12. The vehicle according to claim 8, wherein the vehicle is a fuel cell vehicle.

* * * * *